United States Patent [19]

Neubauer et al.

[11] 4,404,717

[45] Sep. 20, 1983

[54] ENVIRONMENTAL CONTROL OF NEEDLED MAT PRODUCTION

[75] Inventors: Jeffrey A. Neubauer, Boiling Springs, N.C.; Vincent A. Sarni, Pittsburgh, Pa.

[73] Assignee: PPG Industries, Inc., Pittsburgh, Pa.

[21] Appl. No.: 214,832

[22] Filed: Dec. 11, 1980

[51] Int. Cl.[3] ..... D04H 3/10

[52] U.S. Cl. ..... 28/107; 28/112; 65/9; 65/11.1

[58] Field of Search ..... 28/107, 112; 65/4.4, 65/9, 11.1

[56] References Cited

U.S. PATENT DOCUMENTS

| | | | |
|---|---|---|---|
| 2,838,420 | 6/1958 | Valente | 34/23 X |
| 2,959,509 | 11/1960 | Marshall | 28/112 X |
| 3,869,268 | 3/1975 | Briar et al. | 65/9 X |
| 3,883,333 | 5/1975 | Ackley | 65/2 |
| 3,996,032 | 12/1976 | McWilliams et al. | 65/4.4 X |
| 4,158,557 | 6/1979 | Drummond | 65/2 |
| 4,208,000 | 6/1980 | Drummond | 65/11.1 X |
| 4,277,531 | 7/1981 | Picone | 65/11.1 X |
| 4,315,789 | 2/1982 | Tongel | 28/107 X |

*Primary Examiner*—Robert Mackey
*Attorney, Agent, or Firm*—John E. Curley

[57] ABSTRACT

A process is described for improving needling efficiency in the preparation of continuous fiber glass strand needled mat involving subjecting the continuous glass strand mat to environmental treatments before and during needling to control mat moisture and temperatures. A low relative humidity and warm temperature environment is maintained during needling and the mat is exposed to similar treatment prior to needling.

6 Claims, 2 Drawing Figures

ENVIRONMENTAL CONTROL OF NEEDLED MAT PRODUCTION

BACKGROUND OF THE INVENTION

In U.S. Pat. Nos. 3,883,333 and 4,158,557, continuous glass strand mat is shown being produced by traversing continuous strands across the width of a moving conveyor to provide a mat of a given depth. The mat is passed from the conveyor to a needle loom where it is punctured with barbed needles to entangle the strands to provide a mat having mechanical integrity. The strands of this mat are normally moisture laden as they are placed on the conveyor, i.e. moisture content of 10 to 20 percent or more, since as they are formed, they have an aqueous size applied to them. The mats prepared in the aforementioned patent have found particular utility in the production of fiber glass reinforced thermoplastic stamped parts. The size material utilized in coating the strands used to manufacture the mat are typically aqueous emulsions. The size disclosed in U.S. Pat. No. 3,849,148 being typical of the sizes employed.

In one modification shown in U.S. Pat. No. 4,158,577, mat is produced using forming packages as the strand source rather than fiber forming bushings. The forming package strands still have moisture on them though to a lower degree than the strands used in the bushing process i.e. (5 to 8 percent by weight being typical).

It has been found in the production of needled glass strand mat from wet, sized, continuous glass strand mats, the considerable production time is lost in cleaning of the needle looms used since they become fouled with glass and binder or size ingredients which are coated on the strands. A reduction or elimination of such production losses is therefore desirable.

THE PRESENT INVENTION

In accordance with the instant invention, an improvement in the needling efficiency of processes involving the needling of wet continuous strand mat is achieved by imparting to such mats a series of environmental treatments prior to and during the needling. Thus, in a preferred embodiment of the invention, wet, continuous strand mat after formation is passed through a drying zone in which it is contacted with a low relative humidity gas, preferably air, at temperatures maintained below 120° F. The mat as it emerges from the drying zone is then contacted with a low humidity gas at temperatures below 120° F. at the surface opposed to the surface through which gas was passed in the drying zone. This surface treatment of the mat in the second zone removes residual moisture that tends to form on the mat surface opposed to the surface through which gas was passed in the drying zone. The mat is then passed into a needling zone which is provided with a low humidity environment at temperatures below 120° F. and is maintained as such during needling.

It has further been found that the maintenance of a low humidity environment at temperatures below 120° F. in a needling zone in which glass strand mat containing 1 to 2 percent moisture is being needled in and of itself will reduce fouling in the zone to a significant degree.

BRIEF DESCRIPTION OF THE DRAWING

While the novel features of the invention are set forth more particularly in the appended claims, a full and complete understanding of the invention may be had by referring to the detailed description as set forth hereinafter and as may be seen in the accompanying drawings in which:

DETAILED DESCRIPTION OF THE PREFERRED EMBODIMENTS

Figure 1:
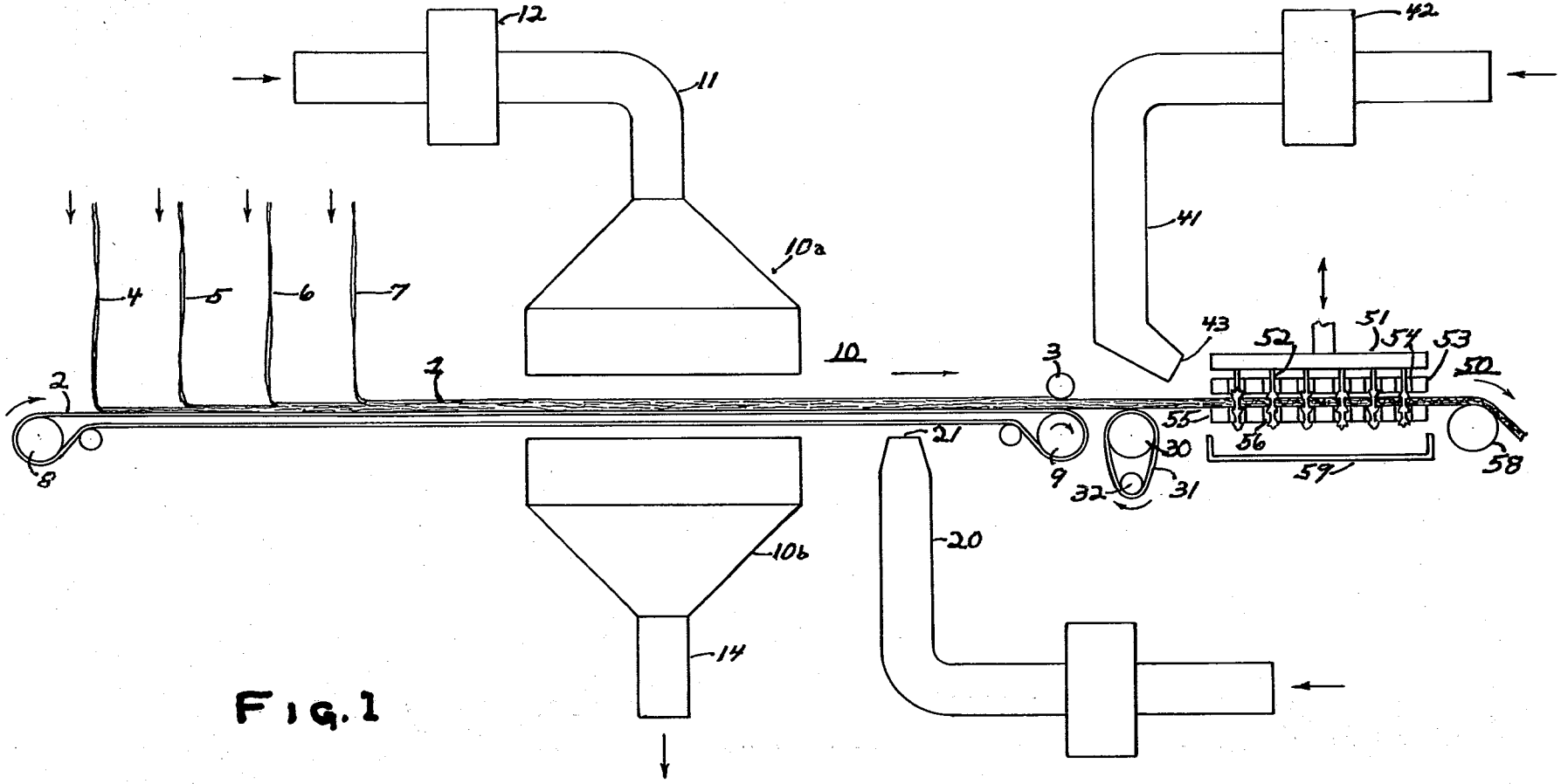
FIG. 1 is a diagrammatic side elevation of a continuous strand mat making operation involving mat needling incorporating the present invention.

As shown in FIG. 1, continuous strand glass mat 1 is formed from a plurality of fiber glass strands 4, 5, 6, and 7 which are projected downwardly onto a conveyor 2, preferably a wire neck chain. While not evident from the drawing, the strands 4, 5, 6, and 7 are traversed across the width of the conveyor 2 on a continuous basis to cover the conveyor 2 with glass strands. The strands 4, 5, 6, and 7 may be drawn directly from a glass fiber forming bushing or from a forming package as shown in the aforementioned U.S. Pat. No. 4,158,557.

The mat 1 having been layered by the plurality of strands 4, 5, 6, and 7 to a desired depth typically contains moisture. If the strands 4, 5, 6, and 7 are originating from a glass fiber forming bushing, this will be in the range of 20 percent or less, typically 12 to 15 percent. If the strands 4, 5, 6, and 7 are being fed from a forming package feed, the moisture content is usually 8 percent or less, typically 4 to 6 percent. The mat 1 is continuously passed through an oven 10. The oven 10 is connected to a duct 11 which is provided with a heater 12, preferably a resistance heater, to heat the gas passed into duct 11. The heated gas which is preferably air is passed into a hood **10*a* of oven 10 which covers the mat conveyor 2 across its width and extends a distance along the length of the conveyor sufficient to provide a residence time for mat in the oven proper of between 50 and 120 seconds, preferably 70–90. Duct 11 is fed with air at a relative humidity of 60 percent or less, typically at least 20 percent and below 60 percent, preferably 40 percent to 50 percent. The air passes from duct 11 through hood 10*a* and through the mat 1. The air after passage through the mat 1 is exhausted through the chamber 10*b* to duct 14**.

The mat 1 after passing through the oven 10 is conveyed over an elongated duct 20 which has a slot like opening 21 which extends to across the width of mat 1. Duct 20 is also provided with a heater 22 to heat gas passed into the duct 20 and the gas, again preferably air, is controlled to provide low relative humidity, i.e. 60 percent or less, typically at least 20 percent and below 60 percent. The preferred air stream is passed into contact with the under surface of mat 1 and removes from the surface residual moisture that tends to collect on the bottom surface strands and those close to that surface as a result of the drying in oven 10. It has been found that in oven 10 as the gas passes through the mat, it tends to become saturated or nearly saturated so that, while the bulk of the mat 1 is dried, there is a tendency for the under surface of the mat to retain some moisture.

The mat 7 is then passed between nip roll 3 and drive roll 9 which with roll 8 is used to continuously advance conveyor 2 through the mat forming area. Drive roll 30, and chain 31 associated therewith and idler roll 32, around which chain 30 rides are operated at speeds to draft mat 1 from nip roll 3 to the desired density. Thus mat 1, at whatever its thickness, can be stretched by chain 30 to provide a mat of lower density than the mat between rolls 3 and 9, if desired.

The mat 1 is conveyed from the surface of chain 30 to the needler 50. As shown, needler 50 has a needle board 51 to which are affixed a plurality of needles 52, typically arranged in parallel rows. The needler 50 is provided with a stripper plate 53, with appropriate drilled holes 54, arranged in rows so that needles 52 can readily pass through them during needling. A bed plate 55 is also provided in needler 50 which also has a plurality of holes 56 arranged in rows and sized so that needles 52 of needle board 51 may pass through them. Plate 55 also serves as a surface on which mat 1 rests during its passage through the needler 50. As shown, the needle board 51 reciprocates as depicted by the arrows to push needles 52 through mat 1 and both of the plates 53 and 55 to thereby entangle the strand forming mat 1 during its passage through the needler 50. Mat 1 is advanced through the needler 50 by the drive roller 58 which exerts a pulling force on mat 1. Track 59 is supplied to catch broken glass filaments passing through the holes 56 of plate 55.

The needler 50 and in particular the needling zone, i.e. the area between plates 53 and 55 in needler 50 is environmentally controlled to maintain that zone at temperatures of between about 50° F. to 120° F. and a relative humidity of below 60 percent, typically at least 20 percent and below 60 percent and preferably 40 to 60 percent. The environment is controlled by continually passing gas at low relative humidity into the needling zone from duct 41. Duct 41 has a heater 42 associated with it so that gas passing into the duct can be heated to a desired value and the gas is humidity controlled to provide the requisite relative humidity. The end of duct 41 is provided with a generally rectangular slot 42 extending the width of the needling zone to insure even distribution of the low humidity gas across the entrance to the needler 50.

Figure 2:
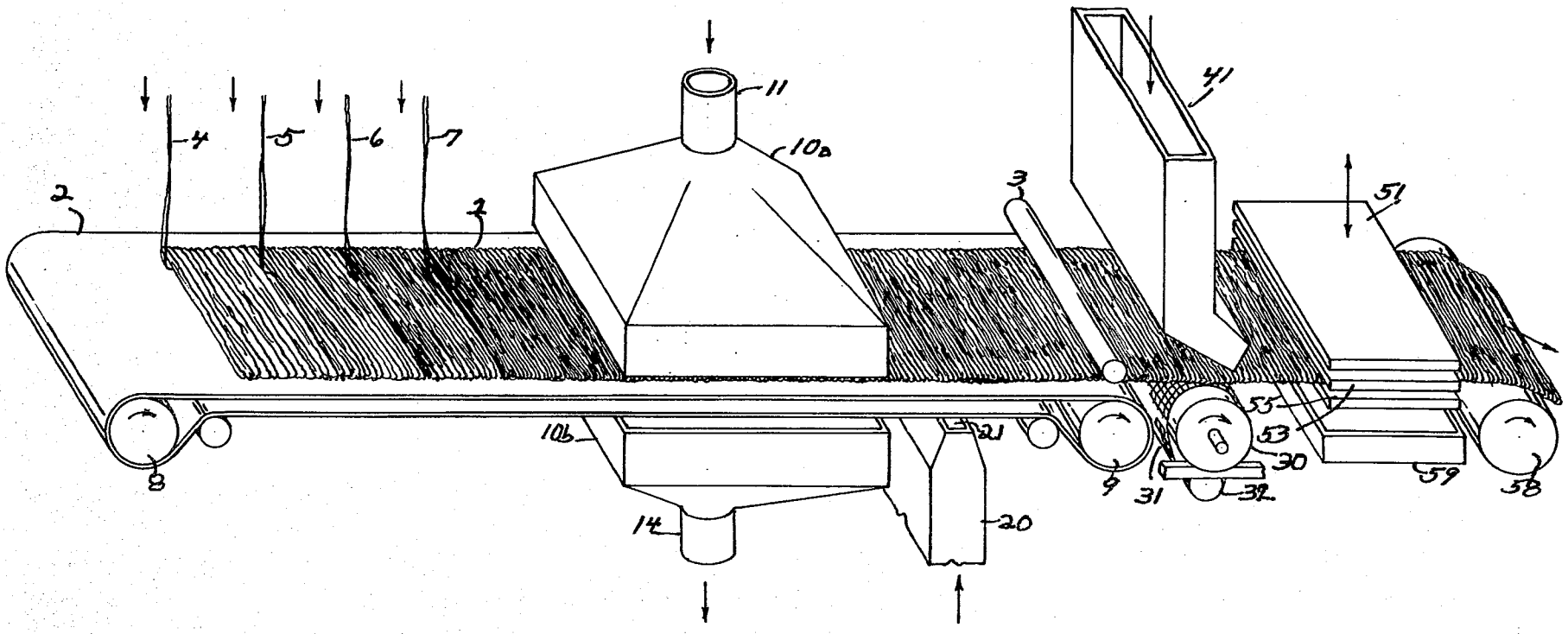
FIG. 2 is a diagrammatic, isometric view of a continuous strand mat making operation including a final needling and using the process of the present invention.

In FIG. 2, the configuration of the ducts 20 and 41 and their associated slots 21 and 43, respectively, can be seen with more particularity. Similarly, the configuration of the heating oven 10 can be appreciated by view of this FIG. 2.

In practicing the invention in accordance with the system shown in FIGS. 1 and 2, mat containing substantial moisture therein typically 4 to 15 percent is fed continuously to the oven 10. Air at temperature between 70° F. to 120° F. is passed through mat 1 from hood 10*a* to the collecting duct 14 in sufficient quantities to provide the mat leaving oven 10 with a substantially reduced moisture content, i.e. 1 to 2 percent basis weight of the mat 1. Air is passed across the width of the mat 1 from duct 20 at 70° F. to 120° F. to reduce the moisture content of the mat further and provide the mat entering needler 50 at a moisture content of 0.5 to 1 percent. In needler 50, with the environment controlled at 70° F. to 120° F. and low relative humidity below 60 percent, the continuous strand mat is needled and emerges at a final moisture content of 0.3 percent or less.

It has been found in operating a needled mat production unit in accordance with the environmental procedure set forth hereinabove that bed plate and stripper plate plugging has been substantially reduced thereby providing less process interruptions and a consequent increase in production.

When the system was operated, for example, to produce 100 inch needled mat at a mat feed rate of 16 feet per minute using all three modes of environmental control, oven drying, bottom drying and needler environmental control in an eight hour shift, only one shutdown for cleaning of bed plates was required. Without the bottom dryer on in a similar eight hour run, three shutdowns for cleaning were required. This represented a 40-minute loss of production compared to the first eight hour run. Further, it has been found that with or without the bottom drying system in operation, the environmental control of the needler has substantially eliminated stripper plate build-up that occurs when it is not used.

While the invention has been described with reference to certain specific preferred embodiments, it is not intended that it be so limited except insofar as appears in the accompanying claims.

We claim:

1. A method of reducing process interruption in the needling of fiber glass continuous strand mat during the forming of a continuous fiber glass strand needled mat from a fiber glass continuous strand mat containing a substantial quantity of moisture comprising feeding said moisture containing continuous mat from a mat forming surface on a continuous basis through a first environmental treatment zone, passing air through said continuous strand mat from its first major surface to the second major surface while maintaining the air fed to the first surface at a temperature of between 70° to 120° F. at a relative humidity of at least 20 percent and below 60 percent, passing the mat from the first treatment zone, to a second environmental treatment zone, contacting the second major surface with air at a temperature of between 70° to 120° F. and a relative humidity of at least 20 percent and below 60 percent in said second zone and passing the resulting environmentally treated mat to a needling zone, needling the mat in said needling zone by penetrating it with a plurality of barbed needles to thereby entangle the continuous strands while maintaining such zone at temperatures between about 50° F. to 120° F. and a low humidity environment thus minimizing process interruption due to fouling of the needling zone with glass fiber and binder and removing from said needling zone a continuous fiber glass strand mat having less than 0.35 percent moisture, said mat having the strands bonded to each other by entanglement caused by the needling.

2. An improved process for preparing a needled mat of continuous glass strands comprising depositing a plurality of continuous glass fiber strands continuously on a moving surface, said strands being placed on said moving surface in a moist condition from a plurality of continuous glass fiber sources and across the width of said moving surface to thereby form a mat of continuous strands on said surface; passing the mat so formed through an environmental treatment zone, contacting one surface of the mat with a supply of conditioned air at a temperature of between 100° F. to 120° F. and at a relative humidity of at least 20 percent in a first zone, contacting the mat after it leaves the first zone with air in another environmental treatment zone at a temperature of at least 100° F. and a relatively humidity of at least 20 percent on the opposed surfaces to the surface treated in the first zone, passing the resulting mat to a needling zone, needling the mat in said zone to mechanically bond by entanglement the continuous glass strands while continuously providing to the needling zone conditioned air at a relative humidity of at least 20 percent and below about 60 percent to maintain such zone at temperatures of between about 50° F. to 120° F. to thereby minimize fouling of the needling zone with glass fibers and binder and improve the overall productivity of the process.

3. In a method of improving the operation of a needling zone by minimizing process interruption for cleaning wherein continuous strand fiber glass mat is being mechanically bonded by penetrating the mat with barbed needles to entangle the strands and wherein the mat contains moisture at a level of between 0.5 to 1 percent the improvement comprising introducing air into the zone of needing in sufficient quantities to establish in said zone an atmosphere which is at a temperature of 50° F. to 120° F. and a relative humidity of between 20 percent and 60 percent to thereby prevent fouling of the needling zone with glass fibers and binder.

4. In a method of reducing process interruption in the needling of fiber glass continuous strand mat which contains 6 percent water therein, the improvement comprising passing conditioned, heated air at temperatures of 70° F. to 120° F. and a relative humidity of at least 20 percent and below 60 percent through the mat as it is conveyed to the needling operation in an environmental treatment zone, contacting one mat surface as it emerges from the environmental treatment zone in a direction countercurrent to the direction of flow of the air in the environmental treatment zone with a second environmental stream of heated air at temperatures of 70° F. to 120° F. and a relative humidity of at least 20 percent and below 60 percent to remove moisture from the mat surface, passing the mat to the needing zone and introducing a stream of conditioned air at relative humidity of at least 20 percent and below 60 percent into the needling zone and across the surface of the mat opposite the surface of the mat treated with said second environmental stream of conditioned air to maintain such zone at temperatures of between about 50° F. to 120° F. to thereby reduce fouling in the needling zone by glass fibers and binder.

5. In a process for needling a continuous strand glass mat and wherein the mat contains moisture at quantities less than 1 percent by weight of the glass, the improvement comprising feeding a quantity of conditioned air to the needling zone in which the said mat is being penetrated by barbed needles to entangle the continuous strands to form an integral, bonded mat thereby, said conditioned air being sufficient in volume to provide in the needling zone a temperature of 70° F. to 120° F. and a relative humidity of at least 20 percent and below 60 percent to thereby reduce fouling in said needling zone by glass fibers and binders.

6. The method of claim 5 wherein the temperature of the needling zone is maintained between 70° F. and 130° F. and the relative humidity is between 20 and 50 percent absolute.

* * * * *

UNITED STATES PATENT AND TRADEMARK OFFICE

CERTIFICATE OF CORRECTION

PATENT NO. : 4,404,717

DATED : September 20, 1983

INVENTOR(S) : Jeffrey A. Neubauer and Vincent A. Sarni

It is certified that error appears in the above-identified patent and that said Letters Patent is hereby corrected as shown below:

Claim 3, line 14 "needing" should be --needling--.

Claim 4, line 4 "needing" should be --needling--.

Claim 6, line 27 "130°" should be --120°--.

Signed and Sealed this

*Thirteenth* Day of *March 1984*

[SEAL]

*Attest:*

GERALD J. MOSSINGHOFF

*Attesting Officer*

*Commissioner of Patents and Trademarks*